US006934970B1

(12) United States Patent
Watkins et al.

(10) Patent No.: US 6,934,970 B1
(45) Date of Patent: Aug. 30, 2005

(54) FIRE PROTECTIVE COAT WITH FREE-HANGING THROAT TAB

(75) Inventors: Susan Watkins, Ithaca, NY (US); Julie Snedeker, Northwood, NH (US); Mark Mordecai, Hampton, NH (US)

(73) Assignee: Globe Manufacturing Co., Pittsfield, NH (US)

( * ) Notice: Subject to any disclaimer, the term of this patent is extended or adjusted under 35 U.S.C. 154(b) by 0 days.

(21) Appl. No.: 10/815,677

(22) Filed: Apr. 2, 2004

(51) Int. Cl.[7] ..... A41D 1/00
(52) U.S. Cl. ..... 2/96; 2/98
(58) Field of Search ..... 2/69, 81, 85–87, 2/93, 96–100, 129, 131, 135, 141.1, 141.2, 2/424, 468

(56) References Cited

U.S. PATENT DOCUMENTS 3,833,938 A * 9/1974 Shweid ..... 2/96
5,083,319 A * 1/1992 Grilliot et al. ..... 2/98
5,153,941 A * 10/1992 Grilliot et al. ..... 2/98
5,167,037 A * 12/1992 Grilliot et al. ..... 2/98
5,189,737 A * 3/1993 Ribicic ..... 2/93
5,297,295 A * 3/1994 Barbeau et al. ..... 2/96
5,638,547 A * 6/1997 Hewitt ..... 2/81
5,685,015 A * 11/1997 Aldridge ..... 2/81
5,991,924 A * 11/1999 Grilliot et al. ..... 2/98

* cited by examiner

*Primary Examiner*—Gary L. Welch
(74) *Attorney, Agent, or Firm*—Dykema Gossett PLLC

(57) ABSTRACT

A fire protective coat to be worn by a firefighter, an emergency responder, a rescue worker, etc., includes a throat protector for protecting the throat area of the wearer, the throat protector including an elongated tab of fire and heat resistant fabric material which is connected by a flexible connector strip to the coat collar, the elongated tab including attachment means on a rear surface for detachable connection with attachment means on the right and left front portions of the collar to maintain the elongated tab in a use state across the front gap of the collar. Additional attachment means on the elongated tab can detachably connect to other attachment means to maintain the elongated tab in a folded condition when in a non-use state. The flexible connector means allows the elongated tab to freely hang from the collar with the attachment means thereon facing the coat when the elongated tab is not connected to the collar.

12 Claims, 2 Drawing Sheets

FIRE PROTECTIVE COAT WITH FREE-HANGING THROAT TAB

BACKGROUND OF THE INVENTION

1. Field of the Invention

The present invention relates to fire protective apparel, in particular to fire protective coats, and more particularly to fire protective coats which include throat protectors for covering the gap between the left front and right front portions of the coat collar when the collar is in a raised condition.

2. The Prior Art

Throat protectors for fire protective coats worn by firefighters, emergency responders, rescue workers, etc., are well known. These protectors conventionally include elongated strips of fabric that include Velcro® attachment patches for detachably connecting the elongated strips tabs across the gap at the front of the coat collar when the collar is in a raised position. However, known protectors are not constructed such that the Velcro® attachment strips can be protected from the damaging effects of fire, heat or environmental contamination when detached from the collar. This is a disadvantage because such Velcro® attachment patches are not required by code to be constructed of fire and heat resistant materials, and they generally are not. When exposed to the environment, they can become deteriorated over time and eventually inoperative.

We have devised a throat protector construction that includes an elongated fabric strip (tab) for placement over the gap between the front edges of the collar and which includes attachment means that can be protected from the damaging effects of fire, heat and contaminants even when the throat protector is detached from the collar.

SUMMARY OF THE INVENTION

According to this invention a fire protective coat includes a throat protector having an elongated tab that can bridge the gap between the front edges of the coat collar when raised and which defines a front surface and a rear surface, the rear surface including three attachment means, two for attachment to attachment means on the right and left front portions of the collar when in a raised position, and a third for attachment to one of the other two so that the elongated tab, when not connected across the collar gap, can be maintained in a folded state. A flexible connector means attaches the elongated tab to the coat collar so that the elongated tab, when not connected across the collar gap, can freely hang downwardly from the collar and the collar can be folded down to a lowered position. When freely hanging from the collar, the attachment means on the rear surface of the elongated tab will face a front panel of the coat for protection from environmental conditions. Alternatively, the elongated tab can be folded while freely hanging from the collar and maintained in a folded state by interconnection of two of the attachment means on the rear surface thereof, i.e., for protection of all the attachment means on the tab from exposure to surrounding environmental conditions. The elongated tab and the flexible connector means are preferably made of heat and fire-resistant fabric materials.

Further features and advantages of the invention will be understood by reference to the accompanying drawings, taken in conjunction with the following discussion.

DETAILED DESCRIPTION OF THE PREFERRED EMBODIMENTS

Figure 1:
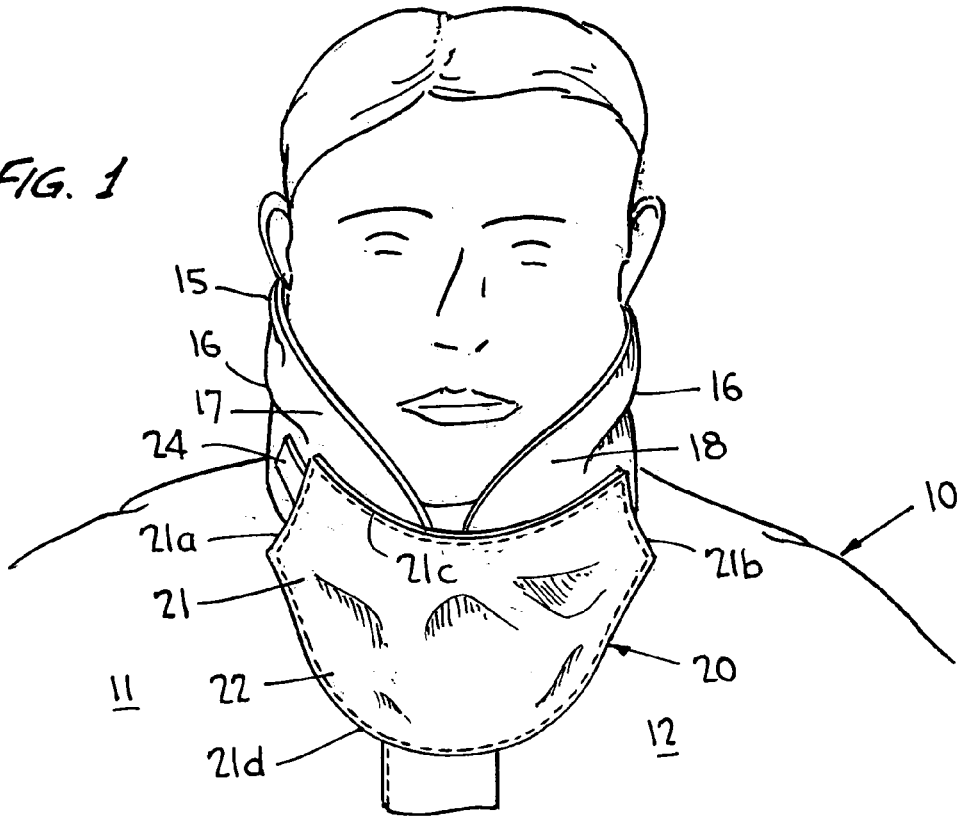
FIG. 1 is a front view of an upper portion of a fire protective coat having a collar and throat protector according to the present invention, the collar being shown in a raised position and the throat tab of the throat protector being shown attached to the collar so as to protect the throat area of a person wearing the coat.
Figure 3:
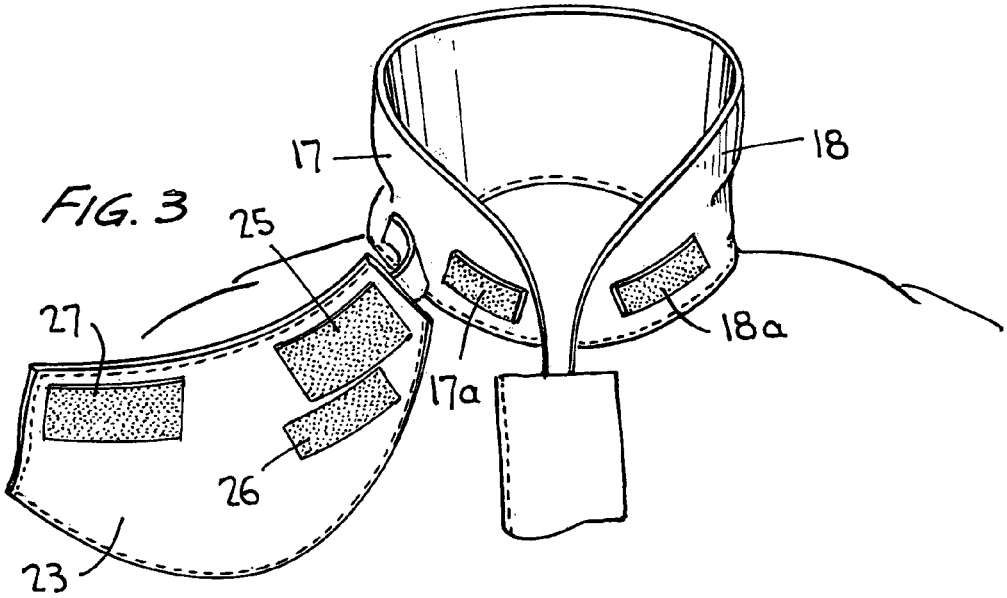
FIG. 3 is a front view of the fire protective coat of FIG. 1 wherein the throat tab is detached from the collar and showing its rear surface with attachment mean thereon.
Figure 2:
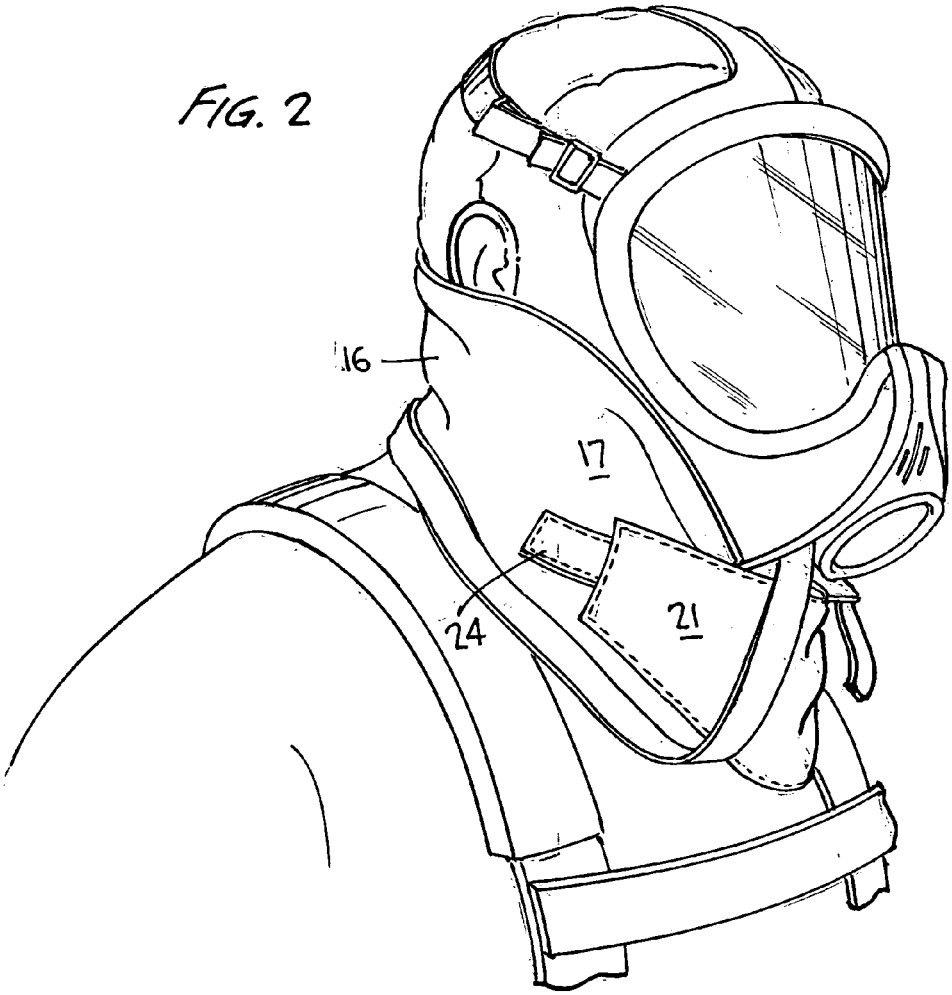
FIG. 2 is a perspective front view of the fire protective coat of FIG. 1 with a faceplate of a SCBA oxygen supply apparatus positioned over the face of the person wearing the coat.
Figure 4:
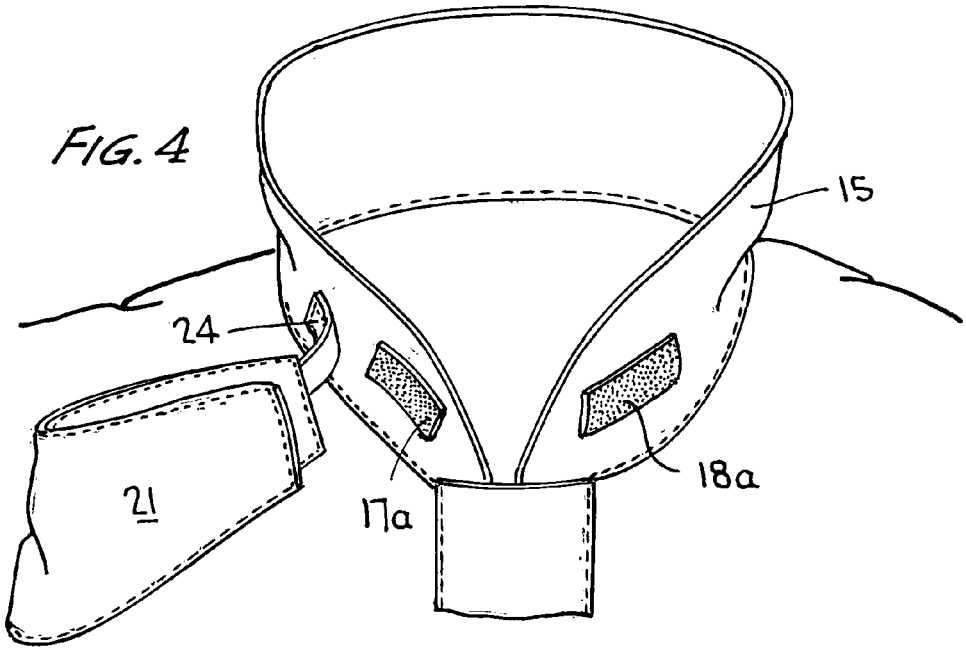
FIG. 4 is a front view of the fire protective coat of FIG. 1 wherein the throat tab is in a folded state.

FIGS. 1–4 depict a fire protective coat 10 having a throat protector 20 according to the present invention. The coat includes a collar 15 which can be folded about a crease 16 into a folded or lowered positioning (not shown) or into a raised positioning as shown in FIGS. 1–4. The collar defines a right front collar portion 17 located above the right front panel 11 of the coat and a left front collar portion 18 located above the left front panel 12 of the coat. As seen in FIG. 3, an attachment means 17*a* is located on the right front collar portion 17 and an attachment means 18*a* is located on the left front collar portion. These attachment means can be hook or loop fastener patches connected to the collar by stitching.

The throat protector 20 includes an elongated tab 21 of heat and flame-resistant material, the tab having a right side edge 21*a*, a left side edge 21*b*, a top edge 21*c*, a bottom edge 21*d*, a front surface 22 and a rear surface 23. The top edge extends along a concave curve between the right and left side edges 21*a* and 21*b*, whereas the bottom edge 21*d* is convexly curved as it extends between the right and left side edges 21*a* and 21*b*. A flexible connector strap 24 is connected at one end to the right front collar portion 17 at a point beneath crease 16 and at its other end to the tab 21 at or near its right side edge 21*a*. The flexible connector strap can be a rectangular piece of heat and flame resistant fabric which is stitched to one end of the collar and at its other end to the elongated tab 21 at or near its right side edge 21*a*.

As can be seen in FIG. 3, attached to the rear surface 23 of tab 21 are attachment means 25, 26 and 27. Attachment means 25 is located near the right side edge 21*a* and is adjustably cooperable with the attachment means 17*a* on the collar to connect the right portion of the tab 21 to the right front collar portion 17. The attachment means 27 is located near the left side edge 21*b* and is adjustably cooperable with the attachment means 18*a* on the collar to connect the left portion of the strip 21 to the left front collar portion 18. The attachment means 26 is located below the attachment means 25 and cooperates with the attachment means 27 to enable the tab 21 to be retained in a folded state (see FIG. 4) when desired. When in this folded state the attachment means 25, 26 and 27 are protected by the tab 21 from exposure to the surrounding environment. The attachment means 25, 26 and 27 can be formed of strips of hook or loop fasteners stitched to the strip 21. When the attachment means 17*a* and 18*a* are patches of loop fasteners, the attachment means 25 and 27 can be patches of hook fasteners, whereas the attachment means 26 can be a patch of loop fasteners so as to detachably couple with the attachment means 27.

The elongated tab 21 of the throat protector 20 can be placed over the gap between the front sides of the collar 15 and the attachment means 17*a*, 25 and 18*a*, 27 adjustably interconnected so as to position the elongated tab to protect the throat area of a person wearing the coat. The bottom edge 21*d* of the strip 21, due to its convex curvature, will contact the front of the coat (see FIG. 2) and the top edge 21*c* will allow for the positioning of various style facepieces of SCBA systems over the wearer's face. The tab 21 can be detached from the collar and folded over to protect the attachment means 25, 26, 27 from exposure to heat, fire or contaminants in the surrounding environment, or else allowed to freely hang down from the collar (due to the flexibility of the connector strap 24) so that the rear surface 23 of the tab 21 with attachment means 25, 26, 27 thereon will face the right front panel 11 of the coat for protection. The collar 15 can be folded over about crease 16 to cover the attachment means 17*a*, 18*a* and protect them from exposure to heat, fire or contaminants in the surrounding environment.

Although a preferred embodiment of this invention has now been shown and described, modifications therein can be made and still fall within the scope of the appended claims.

We claim:

1. A fire protective coat having a collar defining a right front portion and a left front portion and mounting a first attachment means on the right front portion and a second attachment means on the left front portion, said fire protective coat including a throat protector for protecting a throat area of a person wearing the coat, said throat protector including an elongated tab defining a front surface and a rear surface, and including third, fourth and fifth attachment means on said rear surface, said third attachment means being detachably interengageable with said first attachment means, said fourth attachment means being detachably interengageable with said second attachment means, and said fifth attachment means being detachably interengageable with said fourth attachment means, and a flexible connector means fixedly connected at a first end to said elongated tab and at a second end to said collar so that when said first and third attachment means and said second and fourth attachment means are disengaged, said elongated tab can freely hang downward from the collar, or said fourth and fifth attachment means can be interengaged to maintain said elongated tab in a folded state.

2. A fire protective coat according to claim 1, wherein said elongated tab defines a right side edge, a left side edge, a top edge and a bottom edge, and wherein said bottom edge extends between said right and left side edges along a convex curve.

3. A fire protective coat according to claim 2, wherein said top edge of said elongated tab extends between said right and left side edges along a concave curve.

4. A fire protective coat according to claim 1, wherein said first, second, third, fourth and fifth attachment means are formed of patches of hook or loop fasteners.

5. A fire protective coat according to claim 4, wherein said first and second attachment means are patches of loop fasteners, said third and fifth attachment means are patches of hook fasteners, and said fourth attachment means is a patch of loop fasteners.

6. A fire protective coat according to claim 1, wherein said third attachment means is located near said right side edge, said fifth attachment means is located near said left side edge, and said fourth attachment means is located below said third attachment means.

7. A fire protective coat according to claim 1, including a right front coat panel and a left front coat panel, wherein the flexible connector strip is attached to a left front collar portion above said left front coat panel, and wherein said rear surface of said elongated strip can face said left front coat panel when freely handing downwardly from said collar.

8. A fire protective coat according to claim 1, wherein said first and second attachment means are connected to an outer surface of said collar when said collar is in a raised positioning and are covered by said collar when said collar is folded down to a lowered positioning.

9. A fire protective coat according to claim 1, wherein said elongated tab is made of a fire- and heat-resistant fabric material.

10. A fire protective coat according to claim 1, wherein said flexible connector means is made of a fire- and heat-resistant fabric material.

11. A fire protective coat according to claim 1, wherein said first end of said flexible connector is stitched to said elongated tab.

12. A fire protective coat according to claim 1, wherein said second end of said flexible connector is stitched to said collar.

* * * * *